US011717099B2

(12) United States Patent
Acosta

(10) Patent No.: US 11,717,099 B2
(45) Date of Patent: Aug. 8, 2023

(54) DRINKING VESSEL WITH AN INTERCHANGEABLE HANDLE

(71) Applicant: Justinn Acosta, Waipahu, HI (US)

(72) Inventor: Justinn Acosta, Waipahu, HI (US)

( * ) Notice: Subject to any disclaimer, the term of this patent is extended or adjusted under 35 U.S.C. 154(b) by 366 days.

(21) Appl. No.: 16/898,095

(22) Filed: Jun. 10, 2020

(65) Prior Publication Data

US 2020/0390256 A1 Dec. 17, 2020

Related U.S. Application Data

(60) Provisional application No. 62/860,072, filed on Jun. 11, 2019.

(51) Int. Cl.
*A47G 19/22* (2006.01)

(52) U.S. Cl.
CPC ..... *A47G 19/2227* (2013.01)

(58) Field of Classification Search
CPC ..... A47G 19/2205; A47G 19/22; A47G 19/2227; A47J 45/06; A47J 45/067; A47J 45/07; A47J 45/078
USPC ..... D7/515, 536
See application file for complete search history.

(56) References Cited

U.S. PATENT DOCUMENTS

| | | | | |
|---|---|---|---|---|
| 6,102,458 | A | 8/2000 | Scace | |
| 6,237,801 | B1 | 5/2001 | Liu | |
| 6,450,363 | B1 * | 9/2002 | Lin | A47G 19/2205 220/759 |
| 6,588,064 | B2 | 7/2003 | Baum | |
| D505,298 | S | 5/2005 | Holt | |
| D740,608 | S | 10/2015 | Apel | |
| D799,273 | S * | 10/2017 | Wright | D7/515 |
| 11,304,549 | B2 * | 4/2022 | Cheng | A47G 19/2205 |

* cited by examiner

*Primary Examiner* — Javier A Pagan

(57) ABSTRACT

An objective of the present invention is to provide a user with a commonly used item such as a drinking vessel, with the fun characteristics of a firearm. The present invention is a drinking vessel with an interchangeable handle. More specifically, the handle comprises an exterior as that of a handle grip for a firearm. The present invention allows a user to interchange the handle of the drinking vessel with that of a handle grip for a firearm, providing endless combinations and options. The drinking vessel may comprise a variety of materials, including but not limited to, plastic, ceramic, and glass.

14 Claims, 7 Drawing Sheets

DRINKING VESSEL WITH AN INTERCHANGEABLE HANDLE

The current application claims a priority to the U.S. Provisional Patent application Ser. No. 62/860,072 filed on Jun. 11, 2019.

FIELD OF THE INVENTION

The present invention relates to a drinking vessel. More specifically, the present invention relates to a drinking vessel with an interchangeable handle.

BACKGROUND OF THE INVENTION

Firearm inspired products allows individuals to have the fun of playing with firearm-like products without having to be knowledgeable about firearm use and firearm safety. Typical everyday items may look similar to or display firearms, but one of the most entertaining aspects about using firearms is the ability to customize the firearm and improve upon the performance of the firearm by adjusting and replacing its parts of the firearm. Accordingly, a drinking vessel with an interchangeable firearm grip handle is a rare find in the current market.

An objective of the present invention is to provide a user with a commonly used item such as a drinking vessel, with the fun characteristics of a firearm. The present invention is a drinking vessel with an interchangeable handle. More specifically, the handle comprises an exterior as that of a handle grip for a firearm. The present invention allows a user to interchange the handle of the drinking vessel with that of a handle grip for a firearm, providing endless combinations and options. Further, the drinking vessel may comprise a variety of materials, including but not limited to, plastic, ceramic, and glass.

DETAIL DESCRIPTIONS OF THE INVENTION

Figure 1:
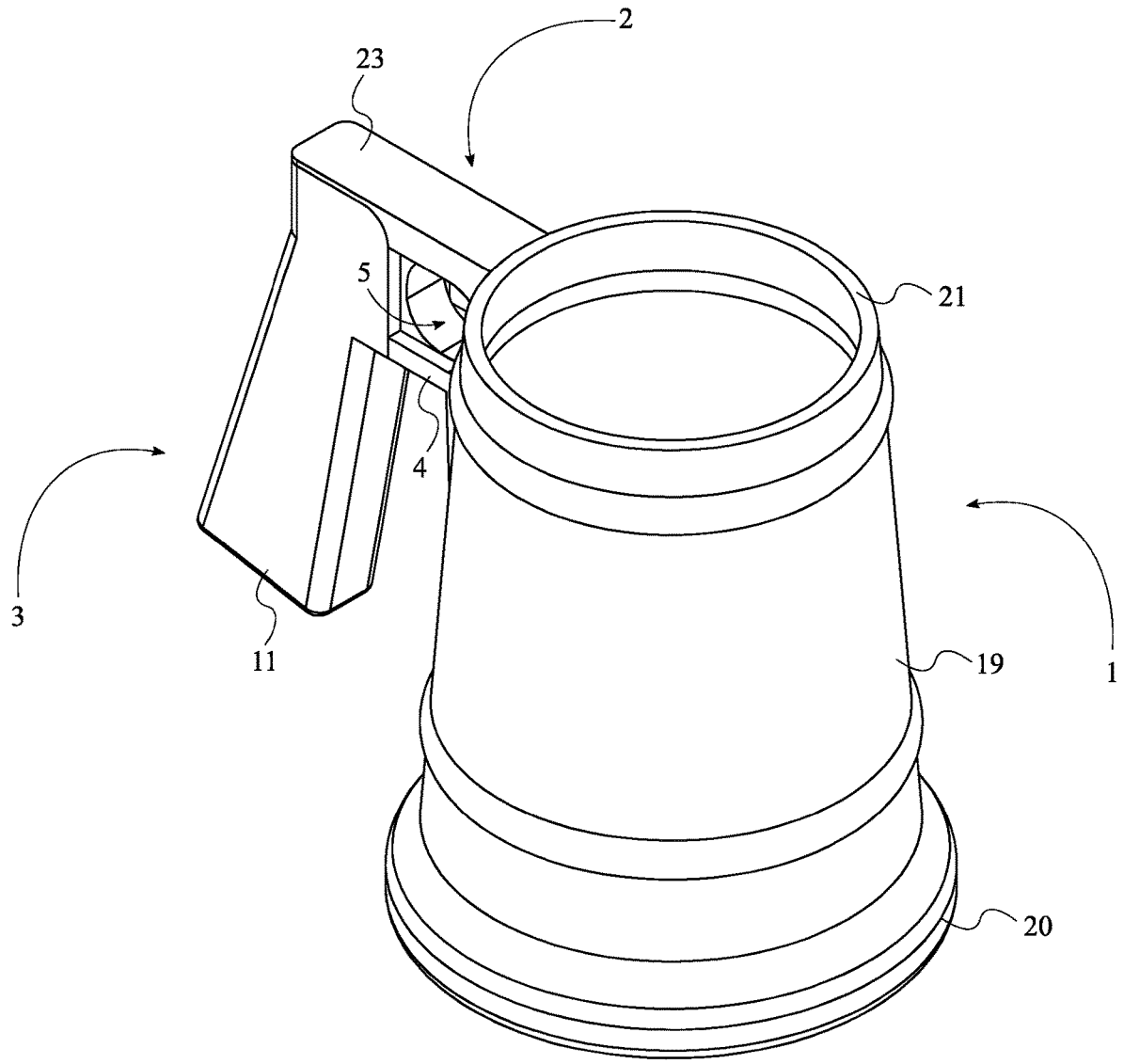
FIG. 1 is a top-front-left perspective view of the present invention.

All illustrations are for the purpose of describing selected versions of the present invention and are not intended to limit the scope of the present invention.

The present invention is a drinking vessel with an interchangeable handle. The present invention mirrors the aesthetic of a firearm with the utility of a drinking vessel. It is an aim of the present invention to effectively support and house a beverage while engaging a variety of handles.

The following description is in reference to FIG. 1 through FIG. 7. According to a preferred embodiment, the present invention allows a user to interchange the handle of the drinking vessel with that of a handle grip for a firearm, providing endless combinations and options. In order to accomplish that, the present invention comprises a drinking vessel 1, a handle attachment 2, and at least one handle 3. The drinking vessel 1, the handle attachment 2 and the at least one handle 3 can be of any shape, size, material, features, type or kind, orientation, components, and arrangements of components that would allow the present invention to fulfill the objectives and intents of the present invention. Examples of such materials include, but are not limited to, plastic, ceramic, glass, silicone etc., as long as the drinking vessel is able to contain a beverage. The at least one handle 3 allows the user to effectively grip the present invention without having to grasp the drinking vessel 1. Further, the handle attachment 2 functions as the link that effectively connects the drinking vessel 1 to the at least one handle 3. Preferably, the handle attachment 2 comprises a main plate 4, a finger slot 5, a connector plate 6, and at least one mounting assembly 7. According to the preferred embodiment, the main plate 4 is laterally mounted onto the drinking vessel 1, such that the main plate 4 is the main external attachment that is in contact with the drinking vessel 1 and the rest of the handle attachment 2. In the preferred embodiment, the main plate 4 is permanently attached to the external surface of the drinking vessel 1. However, it should be noted that, removably coupled handle attachments, that may can temporarily attach to a drinking vessel, as well as fulfill the intends of the present invention also fall under the scope of the present invention.

Figure 5:
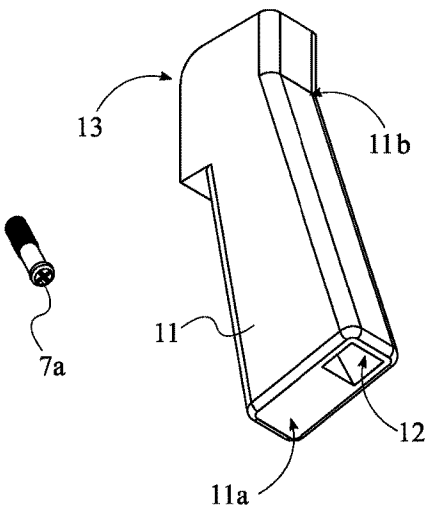
FIG. 5 is an exploded, bottom-rear-right perspective view of the present invention.
Figure 5:
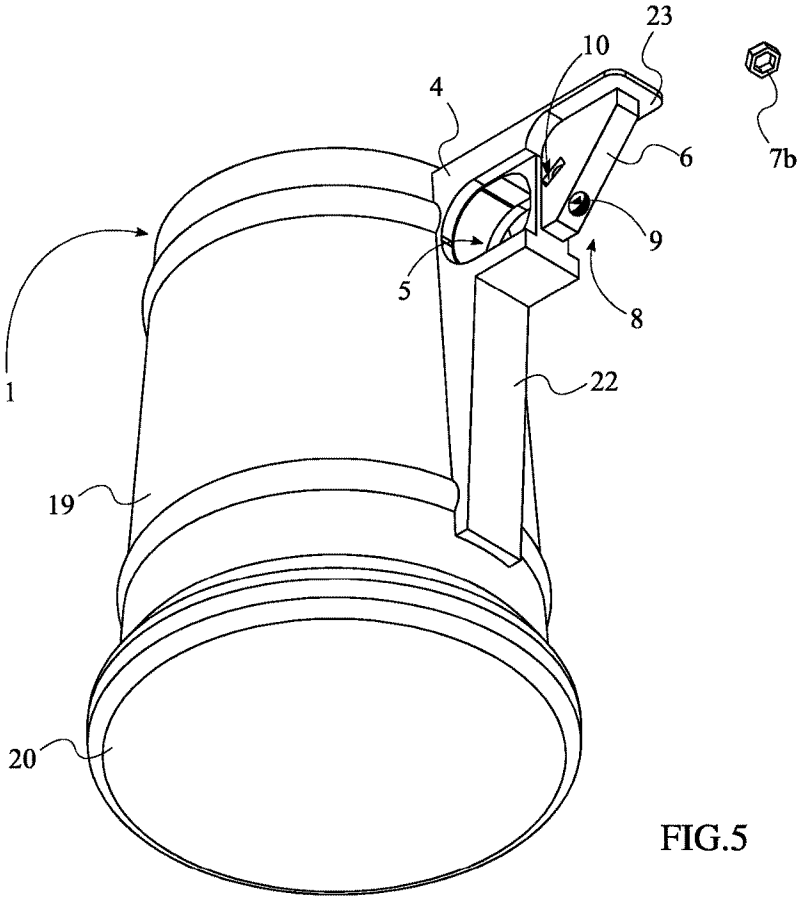
Figure 7:
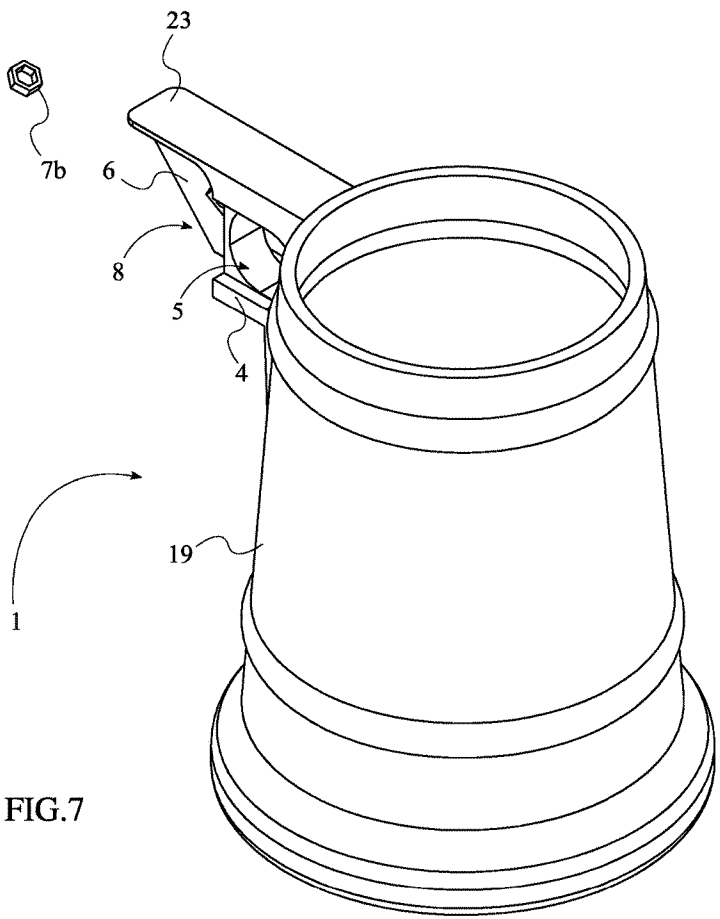
FIG. 7 is an exploded, top-front left perspective view of the present invention.
Figure 7:
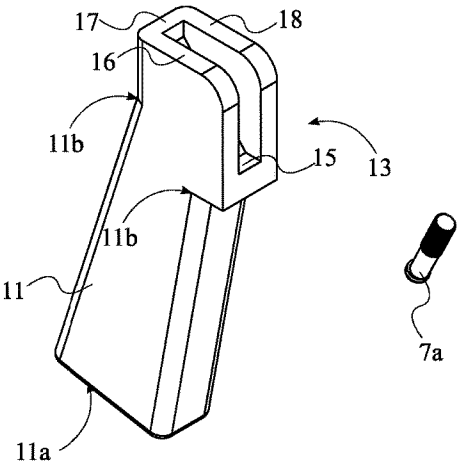

According to the preferred embodiment, the finger slot 5 normally traverses through the main plate 4, and the finger slot 5 is positioned in such a way that, the finger slot 5 allows the user to securely grasp onto the present invention. As seen in FIG. 5 and FIG. 7, the connector plate 6 is attached adjacent the main plate 4, and the connector plate 6 is positioned opposite to the drinking vessel 1, across the main plate 4. The connector plate 6 allows the at least one handle 3 to connect with the drinking vessel 1 with the help of the mounting assembly 7. In other words, the mounting assembly 7 is connected in between the at least one handle 3 and the handle attachment 2. In order to house the mounting assembly 7 in a concealed fashion, the present invention comprises at least one first fastener hole 8, that traverses through the connector plate 6. Further, the first fastener hole 8 is positioned opposite the drinking vessel 1, across the main plate 4, such that when the at least one handle 1 and the handle attachment 2 are connected, the mounting assembly 7 is invisible. The first fastener hole 8 functions to house any fastener that is part of the mounting assembly 7, so as to enable detachable, yet a strong mounting between the drinking vessel 1 and the at least one handle 3. The overall arrangement of the aforementioned components allows the at least one handle 3 to be interchangeable with the drinking vessel 1.

Figure 4:
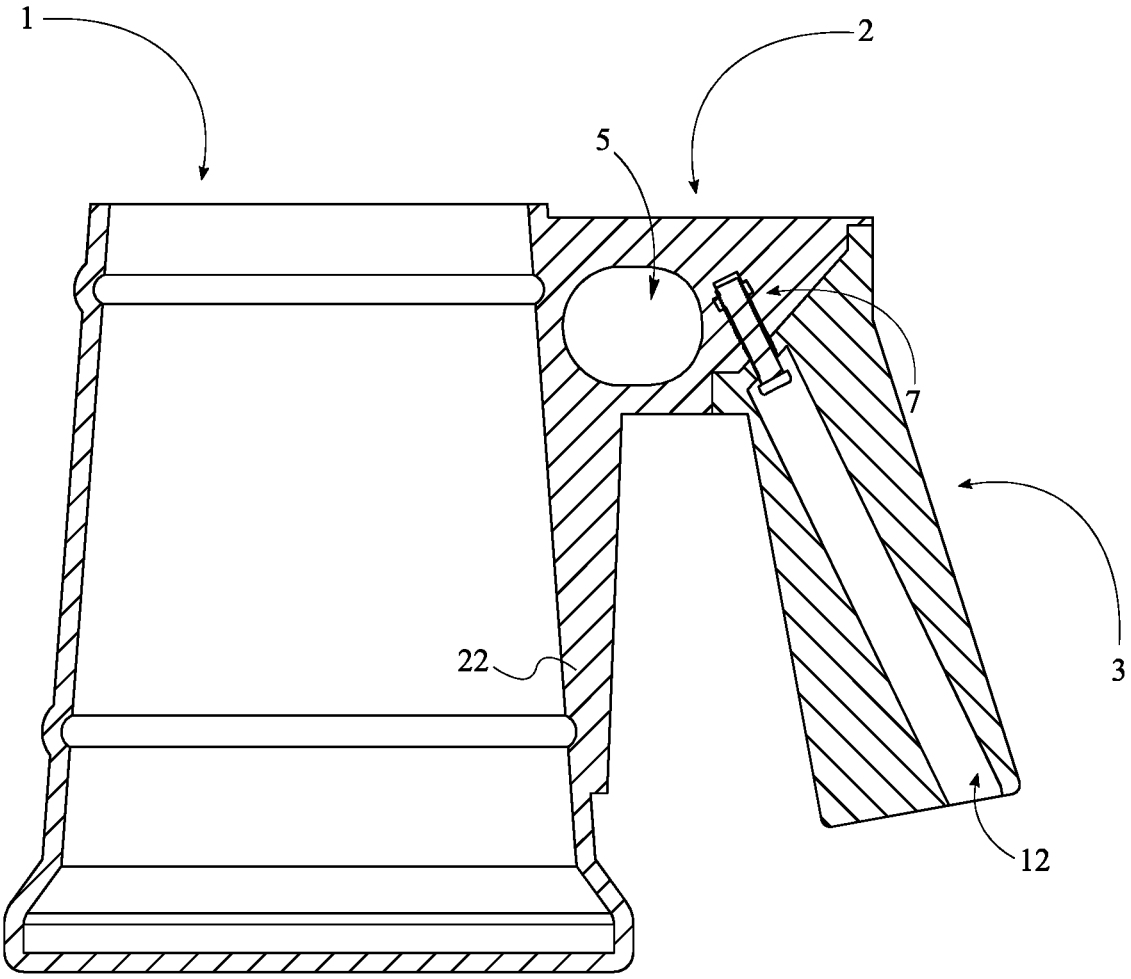
FIG. 4 is a cross-section view taken along line A-A' of the present invention.

As seen in FIG. 4 through FIG. 7, the mounting assembly 7 comprises a connector rod 7*a* and a retention nut 7*b*. Preferably, the connector rod 7*a* comprises a screw and the retention nut 7*b* comprise a regular screw nut. However, the mounting assembly 7 may comprise any other fastening mechanisms that are known to one of ordinary skill in the art, as long as the objectives of the present invention is not altered. Examples of such fastening mechanisms include, but are not limited to snap clips, adhesives, hook and loop fasteners, magnetic fasteners, etc. As seen in FIG. 5, the at least one first fastener hole 8 comprises a first fastener receptacle 9 and a nut slot 10. Preferably, the nut slot 10 normally traverses through the connector plate 6 and the first fastener receptacle 9 traverses laterally through the connector plate 6. This is so that the nut slot 10 and the first fastener receptacle 9 function as a housing for an interlocking fastener, so as to ensure a stronger bond between the handle attachment 2 and the at least one handle 3. In the preferred embodiment, the first fastener receptacle 9 is a cylindrical threaded cavity, and the nut slot 10 is a rectangular slot. However, the at least one fastener hole 8 may comprise any size, shape, orientation etc. for housing any variety of fasteners, as long as the intents of the present invention's is not hindered. Accordingly, as seen in FIG. 4, the first fastener receptacle 9 traverses into the nut slot 10, wherein the retention nut 7*b* is mounted within the nut slot 10 and the connector rod 7*a* engages into the first fastener receptacle 9 and the retention nut 7*b*, thereby providing a strong mechanical connect.

Continuing with the preferred embodiment of the present invention, the at least one handle 3 comprises a handlebar 11, a handlebar slot 12, a connector frame 13, and at least one second fastener receptacle 14. As seen in FIG. 5, the handlebar slot 12 traverses into the handlebar 11 and is oriented from a first end 11*a* of the handlebar 11 to a second end 11*b* of the handlebar 11, wherein the first end 11*a* is positioned opposite the second end 11*b* across the handlebar 11. This is so that, the handlebar slot 12 functions as an access way or pathway from outside to access the mounting assembly 7. Further, according to the preferred embodiment, the connector frame 13 is terminally attached to the second end 11*b*, such that the connector frame 13 attaches the handlebar 11 to the connector plate 6 with the help of the mounting assembly 7. In order further accomplish the mechanical connect with the mounting assembly 7, the second fastener receptacle 14 traverses through the connector frame 13 into the handlebar 11, such that the connector rod 7*a* is engaged into the first fastener receptacle 9 and the second fastener receptacle 14. More specifically, the second fastener receptacle 14 traverses into the second end 11*b* of the handlebar 11 and is positioned adjacent the first fastener receptacle 9. Preferably, the first fastener receptacle 9 is a female-threaded hole, the second fastener receptacle 14 is a female-threaded hole, and the second fastener receptacle 14 is positioned concentric with the first fastener receptacle 9. In other words, the second threaded hole is positioned concentric with the first threaded hole in order for the screw (connector rod 7*a*) to freely and continuously traverse through the second threaded hole, and into the first threaded hole. Thus, the screw is removably engaged with the first screw hole and the second screw hole such that the at least one handle 3 may be interchanged with another depending on the stylistic preferences of the user.

Figure 6:
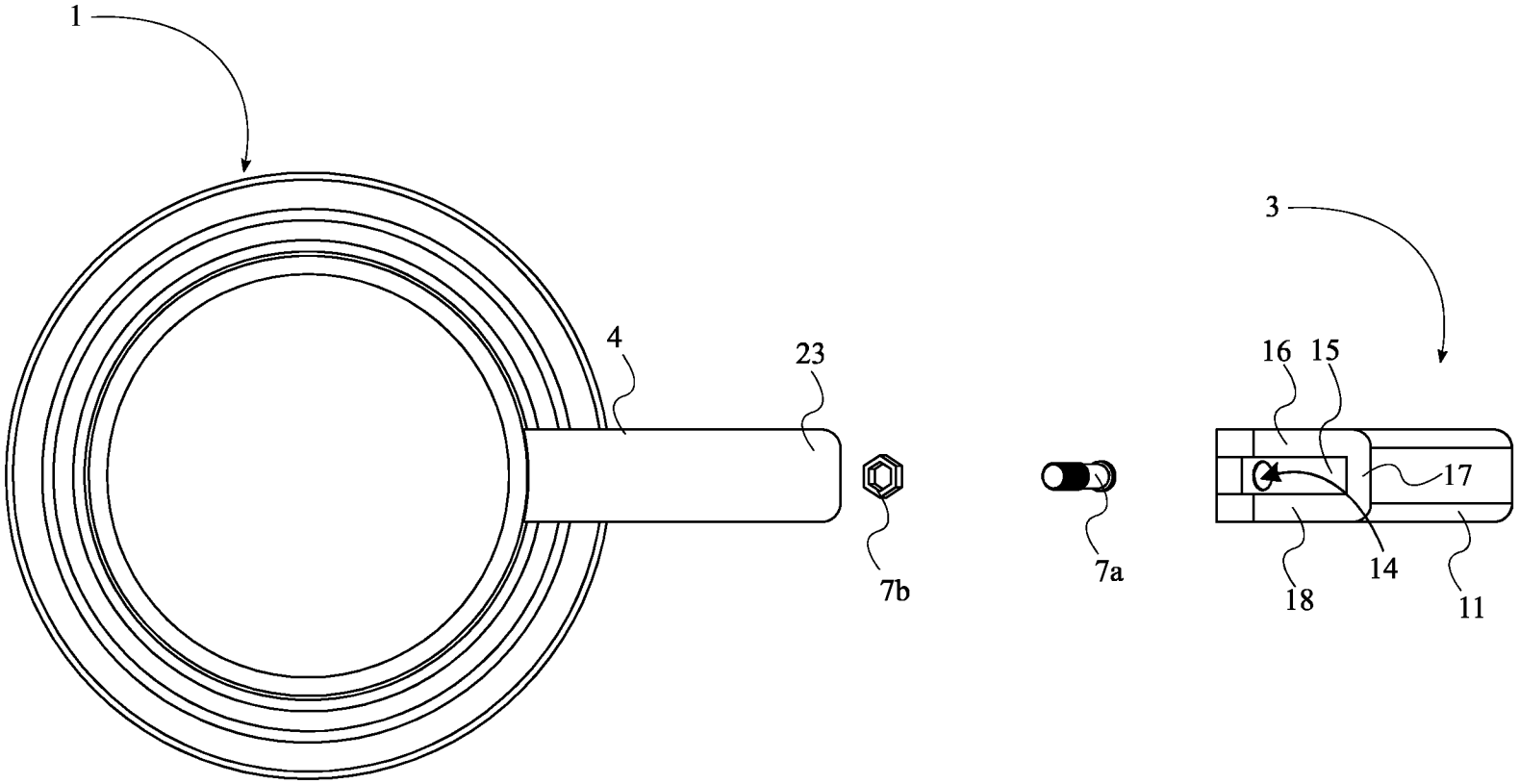
FIG. 6 is an exploded, top side view of the present invention.

In order for the connector frame 13 to completely surround and engage with the connector plate 6, the connector frame 13 comprises a base wall 15, a first lateral wall 16, a second lateral wall 17, and a third lateral wall 18, as seen in FIG. 6 and FIG. 7. Further, the base wall 15 is fixed adjacent the second end 11*b* of the handlebar 11. In the preferred embodiment of the invention the base wall 15 is angled, and the connector plate 6 comprises an angled surface that presses against the base wall 15. The base wall 15 stops the connector rod 7*a* (screw) from slipping through the handlebar 11 and past the connector frame 13. Accordingly, the base wall 15 is terminally fixed adjacent the first lateral wall 16, the second lateral wall 17, and the third lateral wall 18. The first lateral wall 16 is positioned opposite the third lateral wall 18 across the base wall 15. The second lateral wall 17 is positioned in between the first lateral wall 16 and the third lateral wall 18 and connects the first lateral wall 16 and the third lateral wall 18 with each other. The arrangement of the first lateral wall 16, the second lateral wall 17, and the third lateral wall 18 with the base wall 15 defines a slit that the connector plate 6 slips into in order for to attach the at least one handle 3 to the drinking vessel 1 with the mounting assembly 7. Thus, in order for the mounting assembly 7 to attach the connector plate 6 and the connector frame 13, the second fastener receptacle 14 traverses through the base wall 15 into the handlebar 11.

Figure 2:
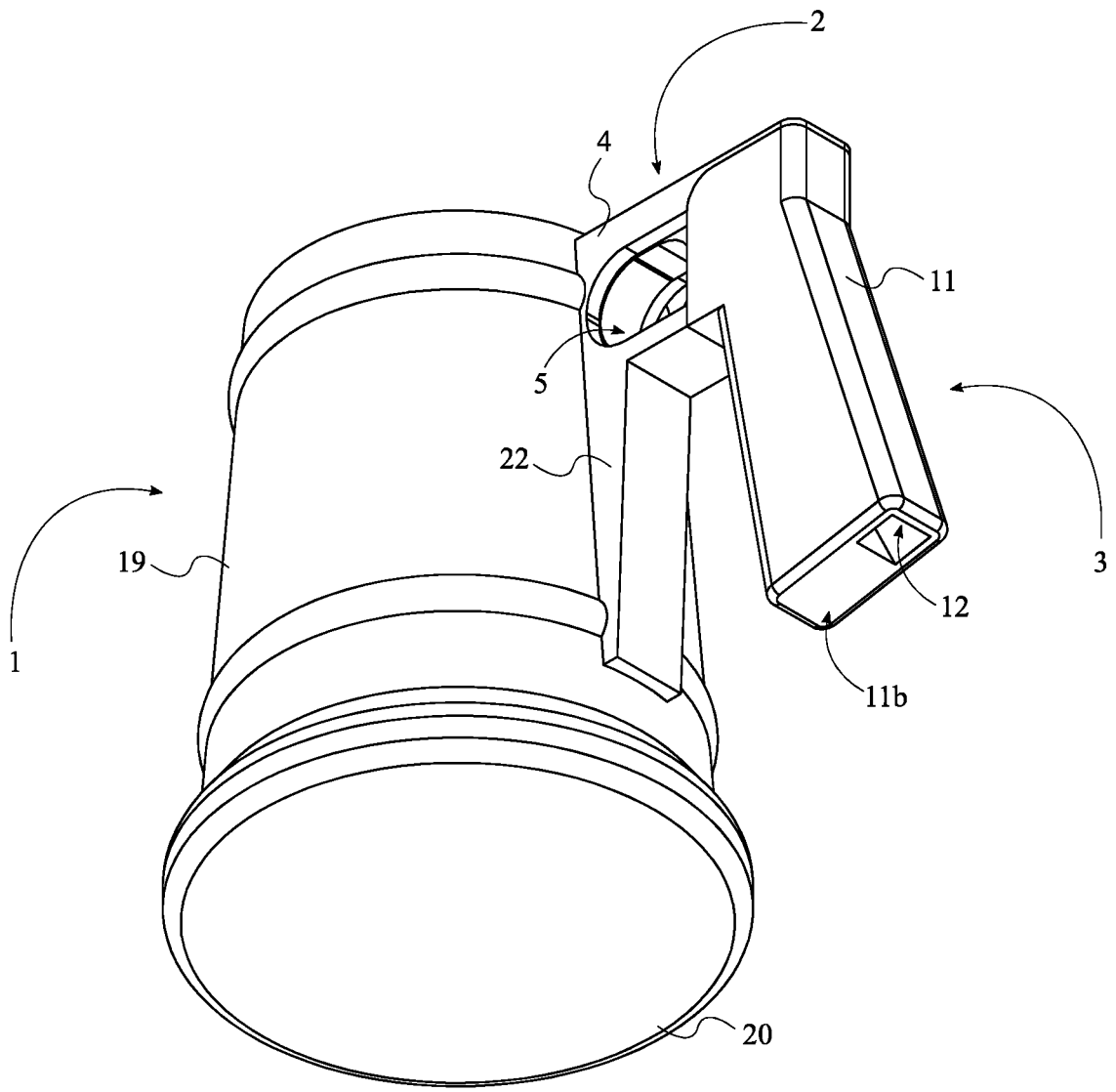
FIG. 2 is a bottom-rear-right perspective view of the present invention.
Figure 3:
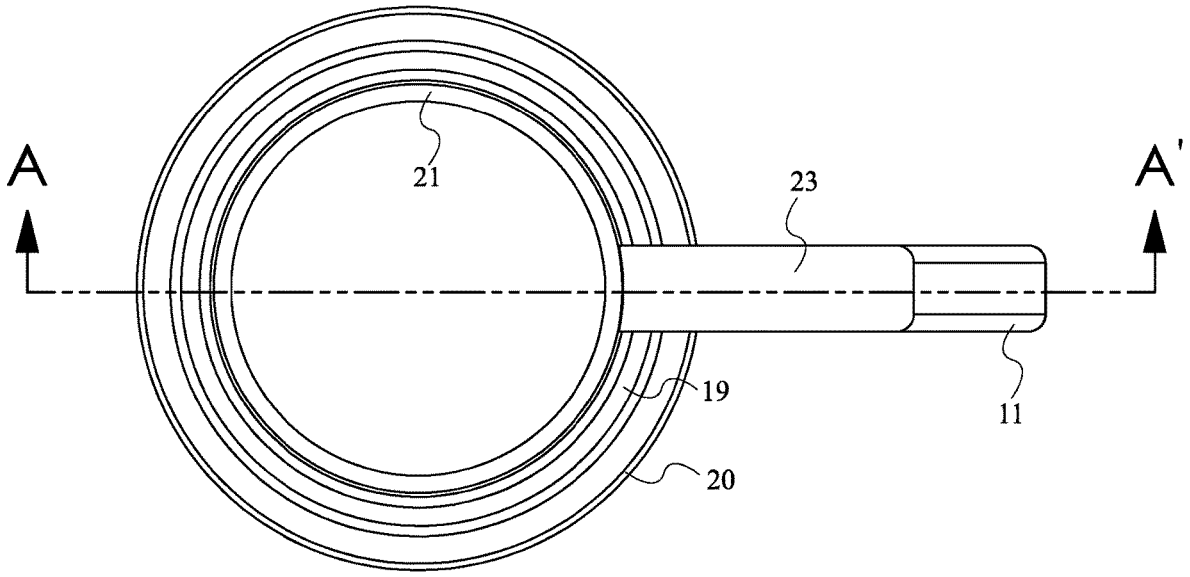
FIG. 3 is a top side view of the present invention.

According to the preferred embodiment, the drinking vessel 1 is able to contain a beverage. In order for the drinking vessel 1 to effectively contain a beverage, the drinking vessel 1 comprises a lateral wall 19 and a base plate 20. The lateral wall 19 and the base plate 20 enclose a beverage while allowing a user to access and receive the beverage within the drinking vessel 1. The drinking vessel 1 is preferably a mug. However, the drinking vessel 1 of alternate embodiments may also be a cup, a thermos, or a variety of other types of drinking vessels. As seen in FIG. 1 and FIG. 2, a rim 21 of the lateral wall 19 is positioned opposite to the base plate 20, across the lateral wall 19. An opening of the drinking vessel 1 is defined by the rim 21, wherein the opening allows a user to access the beverage contained with the lateral wall 19 and the base plate 20. The main plate 4 is externally positioned with the drinking vessel 1 and is laterally fixed along the lateral wall 19.

In order that the connection between the at least one handle 3 and the drinking vessel 1 is structurally reinforced, the present invention further comprises a support post 22, as shown in FIG. 2, FIG. 4, and FIG. 5. The support post 22 relieves the stress of the weight of the drinking vessel 1 with the main plate 4 while the user lifts and maneuvers the present invention with the at least one handle 3. Accordingly, the support post 22 is connected in between the main plate 4 and the rim 21. More specifically, the support post 22 is positioned adjacent the rim 21 and tapers from the main plate 4 to rim 21.

Continuing with the preferred embodiment, the connector frame 13 of the at least one handle 3 is stabilized with the connector plate 6 as the present invention further comprises a stopper plate 23, as shown in FIG. 1 through FIG. 7. Accordingly, the stopper plate 23 is positioned adjacent the main plate 4. Further, the stopper plate 23 is also laterally fixed with the lateral wall 19 of the drinking vessel 1. Furthermore, the stopper plate 23 traverses across the main plate 4 and the connector plate 6, so as to give additional support to the entire handle attachment 2, connecting the drinking vessel 1 and the handle 3. In the preferred embodiment of the present invention, the main plate 4 and the stopper plate 23 each comprise a width that are equal to each other. The connector plate 6 comprises a width that is smaller than that of the stopper plate 23 such that the connector frame 6 of the at least one handle 3 presses against the stopper plate 23.

It is an aim of the present invention to provide users with a drinking vessel 1 that has the fun characteristics of a firearm. The grip of the user goes about the handlebar 11. In order to accomplish that, the at least one handle 3 of the present invention comprises a handle grip of a rifle or pistol and so on. The pistol grip, along with the finger slot 5 in the main plate 4, provides the user the characteristic feeling of holding a firearm. However, it should be noted that, any other grip or handle attachment that is known to one of ordinary skill in the art, which may be removably coupled to the drinking vessel 1 will fall under the scope of the present invention.

Although the invention has been explained in relation to its preferred embodiment, it is to be understood that many other possible modifications and variations can be made without departing from the spirit and scope of the invention.

What is claimed is:

1. A drinking vessel with an interchangeable handle comprising:

a drinking vessel;

a handle attachment;

at least one handle;

the handle attachment comprising a main plate, a finger slot, a connector plate, and at least one mounting assembly;

the main plate being laterally mounted onto the drinking vessel;

the finger slot normally traversing through the main plate;

the connector plate being attached adjacent the main plate;

the connector plate being positioned opposite to the drinking vessel, across the main plate;

the mounting assembly being connected in between the at least one handle and the handle attachment;

at least one first fastener hole;

the first fastener hole traversing through the connector plate;

the first fastener hole being positioned opposite the drinking vessel, across the main plate;

the mounting assembly comprising a connector rod and a retention nut;

the at least one first fastener hole comprising a first fastener receptacle and a nut slot;

the nut slot normally traversing through the connector plate;

the first fastener receptacle traversing laterally through the connector plate;

the first fastener receptacle traversing into the nut slot;

the retention nut being mounted within the nut slot; and the connector rod engaging into the fastener receptacle and the retention nut.

2. The drinking vessel of claim 1, comprising:

the at least one handle comprising a handlebar, a handlebar slot, a connector frame, and at least one second fastener receptacle;

the handlebar slot traversing into the handlebar;

the handlebar slot being oriented from a first end of the handlebar to a second end of the handlebar;

the first end being positioned opposite the second end across the handlebar;

the connector frame being terminally attached to the second end;

the second fastener receptacle traversing through the connector frame into the handlebar; and the connector rod being engaged into the first fastener receptacle and the second fastener receptacle.

3. The drinking vessel of claim 2, comprising:

the connector frame comprising a base wall, a first lateral wall, a second lateral wall, and a third lateral wall;

the base wall being fixed adjacent the second end;

the base wall being terminally fixed adjacent the first lateral wall, the second lateral wall, and the third lateral wall;

the first lateral wall being positioned opposite the third lateral wall across the base wall;

the second lateral wall being connected in between the first lateral wall and the third lateral wall; and the second fastener receptacle traversing through the base wall into the handlebar.

4. The drinking vessel of claim 2, wherein the at least one fastener is a screw:

the first fastener receptacle being a female-threaded hole;

the second fastener receptacle being a female-threaded hole; and the second fastener receptacle being positioned concentric with the first fastener receptacle.

5. The drinking vessel of claim 1 comprising:

the drinking vessel comprising a lateral wall, and a base plate;

the base plate being terminally attached to the lateral wall; and a rim of the lateral wall being positioned opposite to the base plate, across the lateral wall.

6. The drinking vessel of claim 5, further comprising:

a support post;

the support post being connected in between the main plate and the rim; and the support post tapering from the main plate to the rim.

7. The drinking vessel of claim 1, comprising:

a stopper plate;

the stopper plate being positioned adjacent the main plate;

the stopper plate being laterally fixed to the lateral wall; and the stopper plate traversing across the main plate and the connector plate.

8. The drinking vessel of claim 1, wherein the at least one handle comprises a firearm/pistol grip.

9. A drinking vessel with an interchangeable handle comprising:

a drinking vessel;

a handle attachment;

at least one handle;

the drinking vessel comprising a lateral wall, and a base plate;

the base plate being terminally attached to the lateral wall;

a rim of the lateral wall being positioned opposite to the base plate, across the lateral wall;

the handle attachment comprising a main plate, a finger slot, a connector plate, and at least one mounting assembly;

the main plate being laterally mounted onto the drinking vessel;

the finger slot normally traversing through the main plate;

the connector plate being attached adjacent the main plate;

the connector plate being positioned opposite to the drinking vessel, across the main plate;

the mounting assembly being connected in between the at least one handle and the handle attachment;

at least one first fastener hole;

the first fastener hole traversing through the connector plate;

the first fastener hole being positioned opposite the drinking vessel, across the main plate;

the mounting assembly comprising a connector rod and a retention nut;

the at least one first fastener hole comprising a first fastener receptacle and a nut slot;

the nut slot normally traversing through the connector plate;

the first fastener receptacle traversing laterally through the connector plate;

the first fastener receptacle traversing into the nut slot;

the retention nut being mounted within the nut slot; and the connector rod engaging into the fastener receptacle and the retention nut.

10. The drinking vessel of claim 9, comprising:

the at least one handle comprising a handlebar, a handlebar slot, a connector frame, and at least one second fastener receptacle;

the handlebar slot traversing into the handlebar;

the handlebar slot being oriented from a first end of the handlebar to a second end of the handlebar;

the first end being positioned opposite the second end across the handlebar;

the connector frame being terminally attached to the second end;

the second fastener receptacle traversing through the connector frame into the handlebar; and the connector rod being engaged into the first fastener receptacle and the second fastener receptacle.

11. The drinking vessel of claim 10, comprising:

the connector frame comprising a base wall, a first lateral wall, a second lateral wall, and a third lateral wall;

the base wall being fixed adjacent the second end;

the base wall being terminally fixed adjacent the first lateral wall, the second lateral wall, and the third lateral wall;

the first lateral wall being positioned opposite the third lateral wall across the base wall;

the second lateral wall being connected in between the first lateral wall and the third lateral wall; and the second fastener receptacle traversing through the base wall into the handlebar.

12. The drinking vessel of claim 9, further comprising:

a support post;

the support post being connected in between the main plate and the rim; and the support post tapering from the main plate to the rim.

13. The drinking vessel of claim 9, comprising:

a stopper plate;

the stopper plate being positioned adjacent the main plate;

the stopper plate being laterally fixed to the lateral wall; and the stopper plate traversing across the main plate and the connector plate.

14. The drinking vessel of claim 9, wherein the at least one handle comprises a firearm/pistol grip.

* * * * *